United States Patent [19]

Shirai et al.

[11] Patent Number: 4,760,308

[45] Date of Patent: Jul. 26, 1988

[54] ELECTRON GUN FOR COLOR PICTURE TUBES

[75] Inventors: Shoji Shirai, Koganei; Masaaki Yamauchi, Togane; Hiroshi Takano, Hachioji; Masakazu Fukushima, Tokyo; Tatsuo Nishimura, Nagasaki, all of Japan

[73] Assignee: Hitachi, Ltd., Tokyo, Japan

[21] Appl. No.: 307,572

[22] Filed: Oct. 1, 1981

[30] Foreign Application Priority Data

Oct. 3, 1980 [JP] Japan ..... 55-137800

[51] Int. Cl.[4] ..... H01J 29/50

[52] U.S. Cl. ..... 313/412; 313/428; 313/452

[58] Field of Search ..... 313/412, 428, 452; 315/13 C

[56] References Cited

U.S. PATENT DOCUMENTS 4,291,251 9/1981 Bijma et al. ..... 313/412

4,310,780 1/1982 Sakurai et al. ..... 313/412

*Primary Examiner*—William L. Sikes

*Assistant Examiner*—Robert E. Wise

*Attorney, Agent, or Firm*—Antonelli, Terry & Wands

[57] ABSTRACT

An electron gun for a color picture tube has beam generators for generating three electron beams and directing them toward the fluorescent screen along three paths which are parallel with each other on the same plane, and at least one pair of electrode surfaces each having three apertures centered with the three paths for forming independent main lenses so as to focus the electron beams on the fluorescent screen, the electrode surfaces being spaced apart from each other. Provided for the electrode surface are cylindrical shield members centered with the apertures and extending from the apertures in opposition to the opposing electrode surface. Outer ones of the cylindrical shield members have each an end surface inclined with respect to the center axis of the aperture so as to form inclined electric fields effective to converge the outer beams to one point to which the central beam converges.

18 Claims, 4 Drawing Sheets

ELECTRON GUN FOR COLOR PICTURE TUBES

This invention relates to an electron gun for color picture tubes.

Conventionally, in color picture tubes of the type wherein three electron beams are focused by independent main lenses respectively associated with the three beams for excitation of triads of three primary color—red, green and blue-phosphors, it has been the general practice that in order to superimpose images of three primary colors reproduced by the three electron beams, the axis of respective electron guns is inclined by a desired angle with respect to the tube axis so that the three beams are converged to one point on the fluorescent screen (Actual converging point lies on the shadow mask but for simplicity of explanation, assumptive converging point on the fluorescent screen will be referred to hereinafter). This conventional method requires, however, complicated tools for assemblage of the electron guns and suffers from poor accuracy of assemblage.

To eliminate such disadvantages, an electron gun has been proposed wherein electron beams approximately parallel to each other are generated, and they are subjected to focusing and simultaneously to desired convergence by using non-rotationally symmetrical main lenses for convergence of the respective beams to one point on the fluorescent screen. For example, according to U.S. Pat. No. 3,772,554, in so-called in-line guns which generate, on a common plane, three electron beams in substantially parallel relationship with each other, opposing electrodes are provided for formation of two main lenses which focus two outer electron beams and the aforementioned non-rotationally symmetrical lenses are materialized in connection with the two main lenses by displacing the center axis of a high potential electrode of the opposing electrodes outwardly of the center axis of the other low potential electrode. While the central beam focused by a rotationally symmetrical lens travels straightforwardly on a locus parallel to the center axis of the rotationally symmetrical lens, the outer beams deviate from the center axes of divergent lenses formed inside the high potential electrode toward the central beam and they are converged in these directions. As a result, three electron beams are converged to one point on the fluorescent screen.

With the above electrode arrangement, however, the opposing electrodes for the formation of each of the two outer main lenses are not coaxial and for this reason, a special tool which is partly made non-coaxial is required for assemblage of the electrodes, giving rise to sophiticated working of assemblage and degradation of accuracy.

In addition, in order to ensure the displacement of the center axis of the divergent lens standing for the outer main lens, the inner diameter of the high potential electrode needs to be increased or alternatively, the inner diameter of the low potential electrode needs to be decreased. The former expedient increases the outer diameter of an assembled electrode, resulting in an increased diameter of the neck of the picture tube and consequent increase of deflection power. The latter expedient is also disadvantageous in that spherical aberration is increased, followed by degraded resolution.

Japanese Patent Publication No. 38076/78 discloses an electron gun using a non-rotationally symmetrical main lens constructed differently. In this example, opposing surfaces of the electrodes for formation of a main lens are inclined with respect to the center axis of the electron gun to make the main lens inclined, thus materializing a non-rotationally symmetrical lens. Electron beams travelling in substantially parallel relationship with each other are converged toward the direction of the inclination and finally converged to one point on the fluorescent screen.

With this construction, however, since the inclination of the electrode end surfaces conforms to the inclination of the main lens, the amount of beam deflection greatly depends on inclination angle of the electrode end surfaces. Accordingly, slight errors in machining lead to great changes of deflection. This inevitably imposes high accuracies on machining and assembling of the electrodes and the above construction is difficult to practice. In addition, if an integral spacer is used for maintaining a predetermined distance between the electrodes during assemblage of the electrodes, the spacer cannot be drawn out of an assembled electrode. Therefore, divided spacers need to be used, giving rise to poor accuracy in assembling and complexity in working.

Furthermore, since the beams are deflected abruptly within a narrow region near the gap between the electrodes, aberration is increased and the beam spot diameter is also increased.

The present invention contemplates elimination of the above disadvantages and has for its object to provide an electron gun which is easy to fabricate and which can assure convergence of a plurality of electron beams in substantially parallel relationship with each other to one point on the fluorescent screen without causing increase of the electrode diameter and increase of spherical aberration.

To accomplish the above object, an electron gun according to the invention comprises first electrode means for generating at least two electron beams and directing the electron beams toward the fluorescent screen along initial paths which are parallel to each other, and second electrode means for forming independent main lenses on the beam paths to focus and converge each beam to the fluorescent screen, the second electrode means including a pair of electrodes having apertures centered with the beam paths and spaced apart from each other, and shield plates provided for at least one electrode of the paired electrodes, the shield plates forming inclined electric fields within the apertures.

The invention will now be described in conjunction with the accompanying drawings, in which.

Figure 5A:
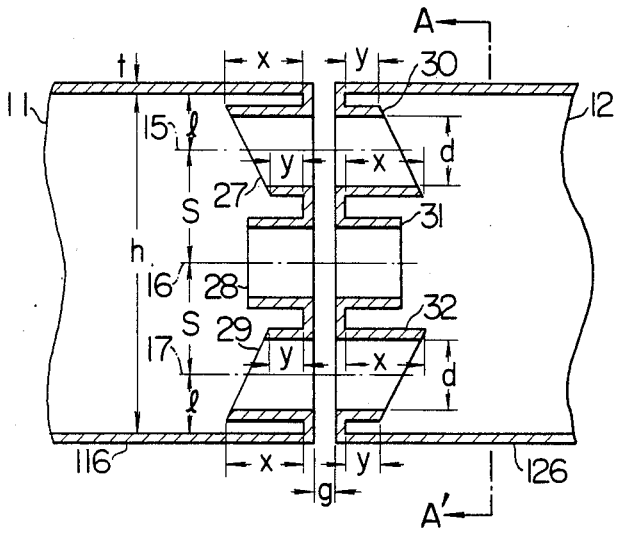
Figure 5B:
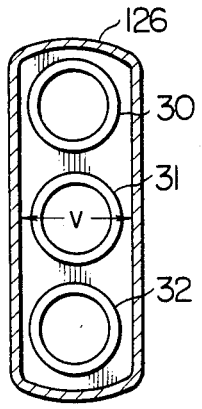

FIG. 5*a* is a sectional view showing an embodiment of an electron gun according to the invention;

FIG. 5*b* is a crosssectional view taken on line A—A' in FIG. 5*a;*

Figure 6:
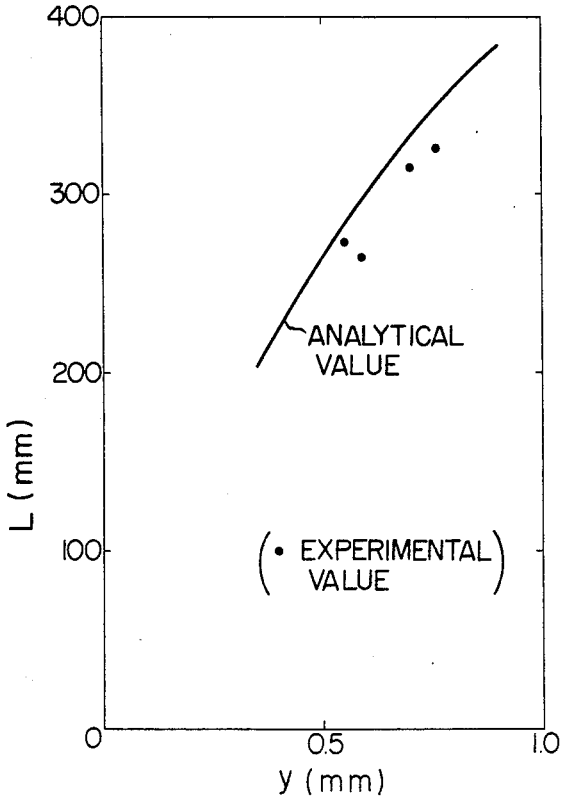
Figure 7:
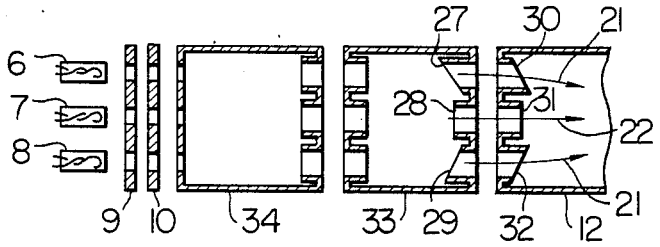
Figure 8:
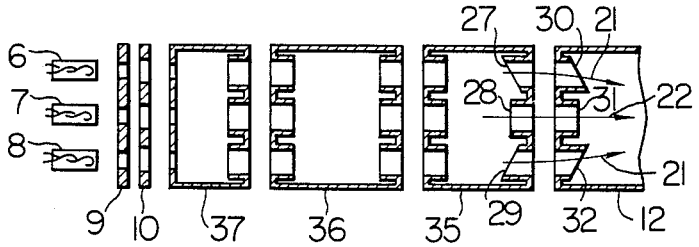

FIG. 6 is a graph showing the relation between axial distance over which three electron beams travel before converged to one point and length of the shield plate; and FIGS. 7 and 8 are section views showing further embodiments of the invention.

Figure 1:
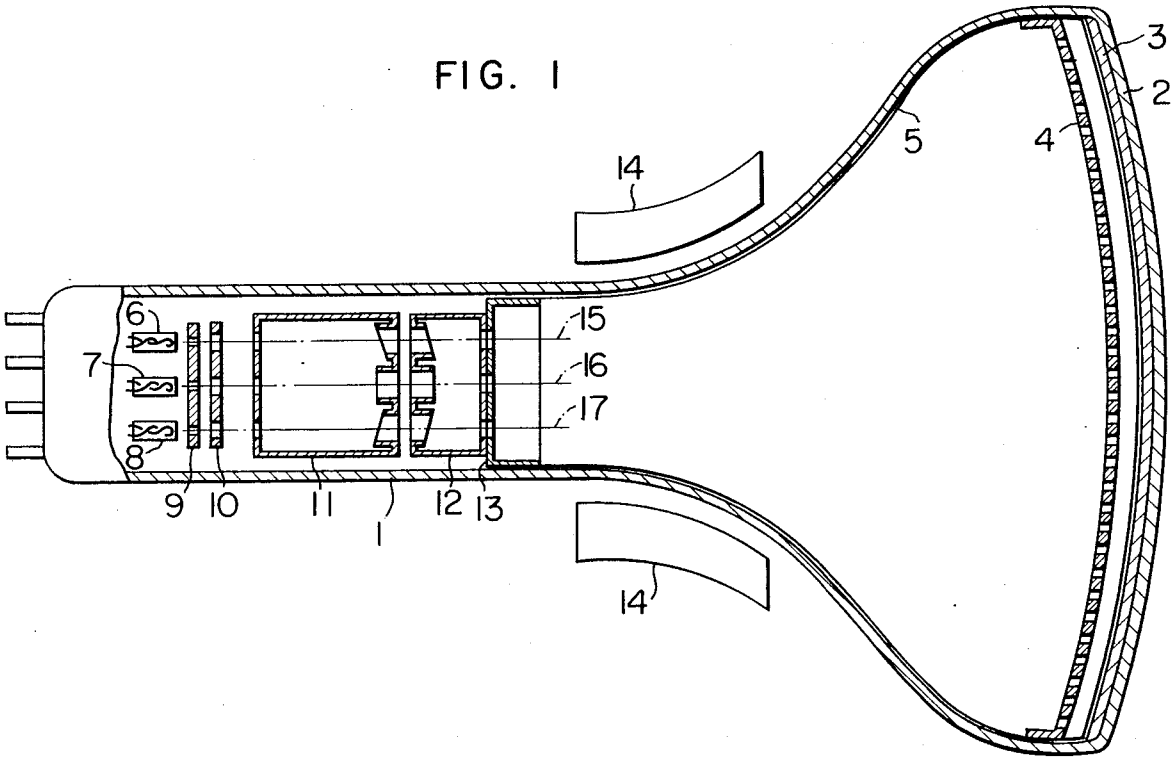
FIG. 1 is a partial longitudinal section view showing one embodiment of a color picture tube with an electron gun according to the invention.

FIG. 1 is a partial longitudinal sectional view of a color picture tube with an electron gun according to the present invention. A fluorescent screen 3 of alternate triads of three-color stripe phosphors is coated on the inner wall of a faceplate 2 of a glass envelope 1. Center axes 15, 16 and 17 of cathodes 6, 7 and 8 are coaxial with center axes of apertures, corresponding to the respective cathodes, of a first grid 9, a second grid 10, electrodes 11 and 12 for formation of main lenses, and a shieldcup 13. The center axes 15, 16 and 17 lie on a common plane in substantially parallel relationship with each other and define initial paths of three electron beams. The three electron beams emitted from the cathodes 6, 7 and 8 come into substantially independent main lenses formed by the electrodes 11 and 12. The electrode 11 is applied with a lower potential than that applied to the electrode 12. This high potential electrode 12 is maintained at the same potential as the shieldcup 13 and a conductive coating 5 applied to the inner wall of the glass envelope 1. Of the electron beams focused by the main lenses, the central beam emitted from the cathode 7 comes into the central main lens of substantially rotational symmetry and leaves this main lens, travelling along the center axis 16. On the other hand, outer beams emitted from the cathodes 6 and 8 are converged toward the central beam (inwardly) by outer main lenses of non-rotational symmetry and leave these main lenses. Thus, the three beams are converged to one point on a shadow mask 4. Denoted by 14 is an external magnetic deflection yoke which applies vertical and horizontal magnetic flux to the three beams so as to scan these beams horizontally and vertically on the fluorescent screen 3.

Figure 2:
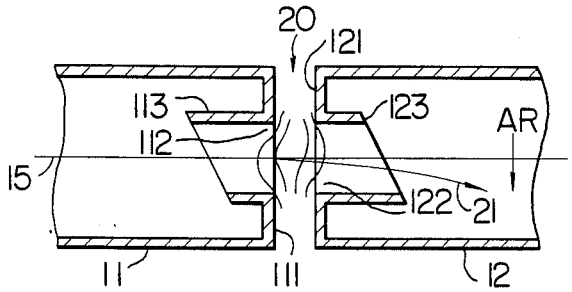
FIGS. 2, 3 and 4 are fragmentary sectional views showing different embodiments of an electron gun according to the invention.

The non-rotationally symmetrical lens used for the electron gun of the present invention will now be described in greater detail.

Where electrodes for formation of the main lenses for focusing the electron beams are independent and are not integral, the non-rotationally symmetrical main lens embodying the invention is constructed as shown, in fragmentary section, in FIG. 2. A low potential electrode 11 and a high potential electrode 12 are spaced apart from each other, having close end surfaces 111 and 121 which are vertical to center axis 15. Formed in the opposing end surfaces 111 and 121 are apertures 112 and 122 of approximately the same diameter which are coaxial with the center axis 15. A cylindrical shield plate 113 off approximately the same inner diameter as the aperture diameter is provided for the aperture concentrically therewith. This cylindrical shield plate 113 terminates in an inclined end surface so that the length of its circumferential wall gradually decreases toward the beam converging direction, namely, in the direction of arrow AR. More specifically, the shield plate 113 is of a cylinder centered with the aperture 112 and having one end close to the electrode 12 and the opposite end inclined with respect to the center axis 15 of the aperture 112. A similar cylindrical shield plate 123 is also provided for the aperture 122 concentrically therewith, having an inner diameter same as the aperture diameter. This shield plate is of a cylinder having the circumferential wall whose length gradually increases, conversely to the shield plate 113, toward the beam converging direction, namely, in the direction of arrow AR. With this construction, the low potential electrode intensively suppresses intrusion of high potential at the maximum length of the cylindrical shield plate circumferential wall, and the high potential electrode intensively suppresses intrusion of low potential at the maximum length. Directions of the suppressions in the two electrodes are symmetrical with respect to the center axis 15, thus producing equipotential lines as shown at 20 in FIG. 2. In other words, there is produced an electric field in which inclined electric fields are superimposed on opposite ends of a rotationally symmetrical focussing electric field. An electron beam 21 is focused and deflected downwardly (in the converging direction AR) by this electric field.

Such a non-rotationally symmetrical main lens is also formed by shield plates 114 and 124 of a semicylinder, equivalent to a half of a cylinder divided in parallel to its axis, provided for apertures 112 and 122 of electrodes 11 and 12. In this case, the semicylindrical shield plate 114 is disposed above the center axis 15 (within an upper half of the electrode 11 in opposition to the beam converging direction AR) whereas the semi-cylindrical shield plate 124 is disposed below the center axis 15 (within a lower half of the electrode 12 in the beam converging direction AR).

Figure 4:
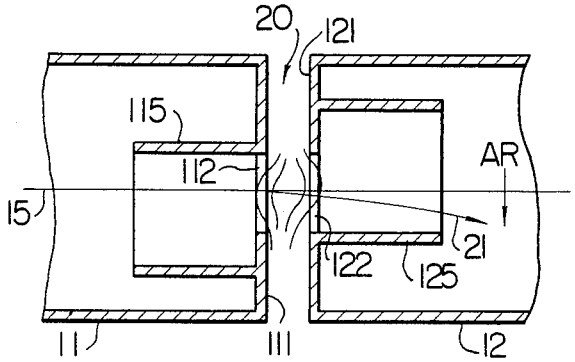

FIG. 4 shows, in fragmentary sectional form, another embodiment of a non-rotationally symmetrical lens formation electrode in accordance with the invention. A cylindrical shield plate 115 is provided for an aperture 112 formed in a low potential electrode 11, having an inner diameter which is larger than the aperture diameter. Similarly, a cylindrical shield plate 125 provided for an aperture 122 in a high potential electrode 12 has an inner diameter larger than the diameter of the aperture 122. The cylindrical shield plate 115 is slightly displaced from the initial beam path 15 (eccentric to the center axis of the aperture 112) toward the beam converging direction AR whereas the cylindrical shield plate 125 is slightly displaced from the initial beam path 15 (eccentric to the center axis of the aperture 122) in opposition to the beam converging direction AR (upwardly in the drawing). Because of the eccentricity of the cylindrical shield plate to the aperture center axis, part of the circumferential wall of the shield plate is kept remote from the aperture center axis in the direction of eccentricity. The more the circumferential wall is remote from the center axis, the more a high potential intrudes into the low potential electrode and a low potential intrudes into the high potential electrode. Since the displacements of the shield plate circumferential walls for the two electrodes are symmetrical with the center axis of the apertures, equi-potential lines as shown at 20 are created and there is produced an electric field in which inclined electric fields are superimposed on opposite ends of a rotationally symmetrical focusing electric field. An electron beam 21 is converged by this electric field in the direction of inclination.

In the embodiment of FIG. 2, the inclination of electric field arises from the suppression of potential intrusion by a half of the circumferential wall of the cylindrical shield plate and therefore, it does not coincide with an inclination angle of the inclined end surface of the shield plate and is smaller than this inclination angle. Accordingly, the amount of beam deflection depends less on the inclination angle of the shield plate end surface and errors in the beam deflection due to errors in machining can be minimized.

Figure 3:
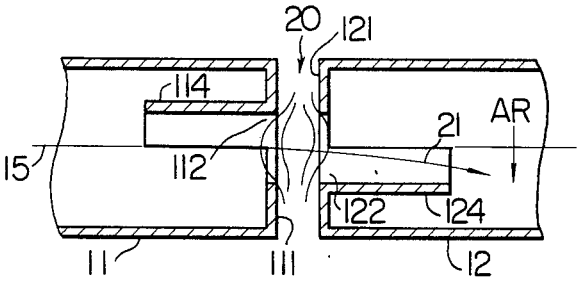

Similarly, the beam deflection depends less on the length of the semi-cylindrical shield plate of the FIG. 3 embodiment so that errors in the beam deflection due to machining errors can again be minimized.

For these reasons, the foregoing embodiments do not require high machining accuracies and are therefore highly practical.

In the electrode arrangements of FIGS. 2, 3 and 4, the electric field is rotationally symmetrical at the intermediate of the gap between the electrodes and is added with non-rotationally symmetrical electric fields at opposite ends of the rotationally symmetrical electric field over wide regions. As a result, the electron beam is gradually deflected through the wide regions, thereby minimizing aberration due to deflection.

The shield plate 113 shown in FIG. 2 can be formed easily by stamping the end surface 111 to form a small elliptical hole which is eccentric to the center axis 15 in the beam converging direction and thereafter by press-squeezing the end surface 111 about the center coincident with the center axis 15. The shield plate 123 can also be formed with ease by applying a similar working to the end surface 121 with only exception that a stamped small ellitical hole is made eccentric in opposition to the beam converging direction.

The shield plate 114 shown in FIG. 3 can be formed easily by stamping the end surface 111 to form a semicircular hole which extends in the beam converging direction and has the same radius and center as those of the aperture 112 and thereafter by press-squeezing the end surface 111 about the center coincident with the center axis 15. The shield plate 124 can also be formed with ease by applying a similar working to the end surface 121 with the only exception that a stamped semicircular hole extends in opposition to the beam converging direction.

The shield plate 115 shown in FIG. 4 can be formed by press-squeezing the end surface 111 about the center which is eccentric to the center axis 15 in the beam converging direction and the shield plate 125 by press-squeezing the end surface 121 about the center which is eccentric in opposition to the beam converging direction. Subsequently, flat plate pieces formed with the apertures 112 and 122 having their centers coincident with the center axis 15 are bonded to the end surfaces 111 and 121 to partly close openings of the cylindrical shield plates 115 and 125.

Since center axes and diameters of the apertures 112 and 122 in the electrodes 11 and 12 are coincident with each other, a complicated tool for assemblage is not needed and the working of assemblage can be simplified and accuracy of positioning can be improved. The electrodes 11 and 12 have the same diameter and hence an increase in electrode outer diameter and is increase in aberration can be prevented.

In addition, since the opposing end surfaces 111 and 121 of the electrodes 11 and 12 are vertical to the center axis, any sophisticated process which is required for accurately inclining these end surfaces with respect to the center axis by desired angles can be dispensed with. The shield plates for formation of the inclined electric field can be machined without requiring the high machining accuracy that is required for inclining the electrode end surfaces. As described above, the invention can remarkably simplify machining and assembling of electrode parts, thus attaining great advantages.

The shield plate is by no means limited to the form of a circular or semi-circular cylinder as in the foregoing embodiments but may take the form of a cylinder of an elliptical crosssection, for example. It is not always necessary to provide the respective shield plates for the two electrodes but the shield electrode for either one of the two electrodes may be eliminated.

Referring to FIG. 5*a*, one embodiment of in-line integral guns incorporating the electron beam converging means of FIGS. 2 and 4 in combination is illustrated in partial sectional form. FIG. 5*b* shows a sectional view on line A—A' in FIG. 5*a*. Three main lenses for focusing three electron beams are established in electrode apertures corresponding to the three beams between electrodes 11 and 12. To make the main lens for focusing the central beam rotationally symmetrical, rotationally symmetrical cylindrical shield plates 28 and 31 are connected to the electrodes 11 and 12, respectively. With this arrangement, the central beam can travel straightforwardly. To ensure static convergence of outer electron beams whereby these beams can be converged inwardly, cylindrical shield plates 27 and 29 having inclined end surfaces are connected to the electrode 11 and cylindrical shield plates 30 and 32 also having inclined end surfaces are connected to the electrode 12. Directions of the inclinations are determined to satisfy conditions for the electron beams to converge in the desired direction, namely, inwardly as explained with reference to FIG. 2.

A low potential electrode 11 has an envelope 116 whose inner wall is close to the outer beam in a direction opposite to the beam converging direction, thus having the same function as the shield plate shown in FIG. 4 for convergence of the outer beam.

A high potential electrode 12 also has an envelope 126 whose inner wall is close to the outer beam in a direction opposite to the beam converging direction, applying deflection to the outer beam in opposition to the beam converging direction. But, because of high potential at the electrode 12, the beam travels at a high speed in the axial direction and is deflected less. As a result, convergence due to the low potential electrode is predominant and the outer beam is eventually converged inwardly.

In case where dimensions depicted in FIGS. 5*a* and 5*b* are such that $h=21.4$ mm, $d=5.5$ mm, $l=4.1$ mm, $t=0.2$ mm, $g=1$ mm, $v=9.4$ mm and $x=2.8$ mm, and the high and low potential electrodes 12 and 11 are applied with potentials of 25 kV and 7 kV, respectively, the three-dimensional field distribution is numerically computed and the electron beam locus within the field is analyzed. Results of the analysis are compared with experimental values to obtain a curve as plotted in FIG. 6. Distance S between the center axis 16 of the central gun and the center axes 15 and 17 of the guns for emitting the outer beams is 6.6 mm, and the three electron beams can be converged to one point when the amount of deflections of the outer beams coincides with the value of distance S. In FIG. 6, the abscissa represents a minimal axial length y common to the shield plates 27, 29, 30 and 32, and the ordinate represents a distance L between one point to which the three electron beams are converged and the end surface of electrode 11 opposing the electrode 12. For color picture tubes of various sizes, the distance L, ranging from that end surface to the fluorescent screen, is 250 to 340 mm. Therefore, as will be seen from FIG. 6, for the low potential electrode applied with 7 kV, the three electron beams can be converged to one point on the fluorescent screen by selecting a value of y from a range of about 0.4 mm to about 0.8 mm in accordance with a value of L.

In FIG. 1, the invention is applied to a so-called bipotential lens in which the main lens is formed by two electrodes, that is, the high potential electrode 12 and the low potential electrode 11. The invention may also be applicable to a so-called uni-potential lens having three electrodes wherein a low potential electrode is interposed between high potential electrodes and to a so-called bi-uni-potential lens having four electrodes wherein a uni-potential lens is added with one low potential electrode disposed close to the cathode.

Referring to FIG. 7, a uni-potential lens embodying the invention is illustrated in partial sectional form. High potential electrodes 34 and 12 are electrically connected to each other and a low potential electrode 33 is interposed therebetween. By the action of shield plates 27, 29, 30 and 32, non-rotationally symmetrical lenses are formed between the electrodes 33 and 12, and outer beams 21 and a central beam 22 are converged to one point on the screen.

Illustrated in FIG. 8 is a bi-uni-potential lens embodying the invention. High potential electrodes 36 and 12 are interconnected electrically and low potential electrodes 35 and 37 are also interconnected electrically. By the action of shield plates 27, 29, 30 and 32, non-rotationally symmetrical lenses are formed between the electrodes 35 and 12, and outer beams 21 and a central beam 22 are converged to one point on the screen.

For convergence of the electron beams, the electrode 33 of FIG. 7 and the electrode 35 of FIG. 8 achieve the same function as the electrode 11 of FIG. 5. Accordingly, when the electrodes 33 and 35 are dimensioned equally to the electrode 11 and applied with the same potential as that applied to the electrode 11 and in addition, dimension and potential are common to the electrodes 12 in FIGS. 5, 7 and 8, results of electron beam locus analyses are the same. Therefore, in the embodiments of FIGS. 7 and 8, the shield plates can be dimensioned properly in accordance with values derived from FIG. 6.

What is claimed is:

1. An electron gun for a color picture tube comprising: first electrode means for generating at least two electron beams and directing the electron beams toward a fluorescent screen of the color picture tube; second electrode means for forming substantially independent main lenses on beam paths of said electron beams respectively to focus and converge the respective beams to the fluorescent screen, said second electrode means including at least a pair of electrodes having respective apertures centered with each other for permitting the respective beams to pass therethrough; and a shield member associated with at least one of the apertures in at least one of the paired electrodes for forming within the associated aperture an electric field inclined with respect to the axis thereof.

2. The electron gun according to claim 1 wherein said shield member comprises a cylinder having the center axis coaxial with that of said aperture, one end surface of said cylinder being inclined with respect to said center axis.

3. The electron gun according to claim 1 wherein said shield member comprises a semi-cylinder having the center axis coaxial with that of said aperture.

4. The electron gun according to claim 1 wherein said shield member comprises a cylinder having an inner diameter which is larger than the diameter of said aperture, the center axis of said cylinder being displaced slightly from the center axis of said aperture.

5. An electron gun for a color picture tube comprising means for generating three electron beams and directing them toward a fluorescent screen of the color picture tube along three paths which are parallel with each other on the same plane, and at least first and second electrodes spaced apart from each other, said first and second electrodes having respective three apertures centered with each other for permitting the three electron beams to pass therethrough respectively, at least one of said electrodes having a central shield member associated with the central aperture of said three apertures for forming an electrical field which is rotationally symmetrical with respect to the axis of the associated central aperture to focus the central beam of said three electron beams, and outer shield members associated with the outer apertures of said three apertures respectively for forming electric fields which are non-rotationally symmetrical with respect to the axes of the outer apertures respectively to focus the outer beams of said electron beams independently and converge the outer beams together with the central beams to one point.

6. The electron gun according to claim 5 wherein each of said shield members comprises a cylinder centered with said aperture and extending from the aperture in opposition to the opposing electrode surface, and wherein the outer cylinders associated with the outer beams have end surfaces inclined with respect to the center axes of associated apertures so as to form inclined electric fields within the associated apertures.

7. The electron gun according to claim 6 wherein each of the outer cylinders provided for the first electrode has a circumferential wall whose length gradually decreases from a wall portion which is outer with respect to the center axis of the electron gun.

8. The electron gun according to claim 6 wherein each of the outer cylinders provided for the second surface has a circumferential wall whose length gradually decreases from a wall portion which is inner with respect to the center axis of the electron gun.

9. The electron gun according to any of claim 6 to 8 which further comprises an envelope electrode having one end connected to said electrode and surrounding said cylinders provided for said electrode to which the surrounding envelope electrode is connected.

10. An electron gun for a color picture tube comprising means for generating at least two electron beams and for directing the electron beams toward a fluorescent screen of the color picture tube, means forming electric focusing lenses for focusing of the respective beams and for enabling convergence of at least one of the beams onto the fluorescent screen, the electric focusing lens means including at least first and second spaced electrode means arranged along the beam paths, the first and second electrode means being provided with respective apertures centered with each other for permitting the respective beams to pass therethrough, and shield means being provided for at least one of the first and second electrode means, the shield means including at least a first means associated with at least a selected one of the apertures of the at least one of the first and second electrode means for forming an electric field which is non-rotationally symmetrical with respect to the axis of the associated aperture for enabling convergence of the electron beam passing therethrough onto the fluorescent screen.

11. The electron gun according to claim 10, wherein the first and second spaced electrode means have different electric potentials applied thereto, and the first means of the shield means comprises a cylindrical member having a center axis coaxial with the axis of the associated aperture, one end surface of the cylindrical member being inclined with respect to the center axis.

12. The electron gun according to claim 10, wherein the first and second spaced electrode means have different electric potentials applied thereto, and the first means of the shield means includes a semi-cylindrical member having a center axis coaxial with the axis of the associated aperture.

13. The electron gun according to claim 10, wherein the first and second spaced electrode means have different electric potentials applied thereto, and the first means of the shield means includes a cylindrical member having an inner diameter which is larger than the diameter of the associated aperture, the cylindrical member having a center axis displaced slightly from the axis of the associated aperture.

14. The electron gun according to claim 10, wherein the means for generating at least two electron beams generates three electron beams toward the fluorescent screen along three paths which are parallel with each other on the same plane, the first and second spaced electrode means having different electric potentials applied thereto, each of the first and second electrode means being provided with three spaced apertures including a center aperture and two outer apertures, the shield means further comprising second means including a central shield member associated with the central aperture for forming an electric field which is rotationally symmetrical with respect to the axis thereof to focus the central beam of the three electron beams, and the first means of the shield means including outer shield members associated with the outer apertures of the three apertures, respectively, for forming electric fields which are non-rotationally symmetrical with respect to the axes of the outer apertures respectively to focus the outer beams of the electron beams independently and to converge the outer beams together with the central beam to one point on the fluorescent screen.

15. The electron gun according to claim 14, wherein each of said central and outer shield members of one of the first and second electrode means includes a cylinder centered with respect to the associated aperture and extending from the associated aperture in a direction away from the other of the first and second electrode means, each of the cylinders of the outer shield members associated with the outer apertures having an end surface inclined with respect to the center axis of the associated aperture for forming an electric field inclined with respect to the axis of the associated aperture.

16. The electron gun according to claim 15, wherein the shield means is provided for the one of the first and second electrode means, and each of the cylinders of the outer shield members has a circumferential wall whose length gradually decreases from a wall portion thereof disposed farthest away from the center axis of the electron gun.

17. The electron gun according to claim 15, wherein the shield means is provided for the other of the first and second electrode means, and each of the cylinders of the outer shield means has a circumferential wall whose length gradually decreases from a wall portion thereof disposed closest to the center axis of the electron gun.

18. The electron gun according to claim 15, wherein at least the one of the first and second electrode means further includes an electrode portion surrounding the cylinders of the central and outer shield members.

* * * * *